US005398603A

United States Patent [19]

Hartmann et al.

[11] Patent Number: 5,398,603

[45] Date of Patent: Mar. 21, 1995

[54] DRIVE FOR A PRINTING PRESS WITH A PLURALITY OF PRINTING UNITS

[75] Inventors: Klaus Hartmann, Schriesheim; Georg Rössler, Angelbachtal, both of Germany

[73] Assignee: Heidelberger Druckmaschinen AG, Heidelberg, Germany

[21] Appl. No.: 73,094

[22] Filed: Jun. 7, 1993

[30] Foreign Application Priority Data

Jun. 5, 1992 [DE] Germany ..... 42 18 604.8

[51] Int. Cl.[6] ..... B41F 7/06; B41F 13/12

[52] U.S. Cl. ..... 101/183

[58] Field of Search ..... 101/181, 183, 177, 221, 101/136, 484, 485, 136, 137, 138-140; 226/27, 28, 30, 42, 2; 318/67, 68, 69, 70; 493/34

[56] References Cited

U.S. PATENT DOCUMENTS

| | | | |
|---|---|---|---|
| 3,557,692 | 1/1971 | Lee | 101/177 |
| 3,600,655 | 8/1971 | Karlin | 318/67 |
| 3,946,669 | 3/1976 | Johne et al. | 101/183 |
| 4,604,083 | 8/1986 | Barny et al. . | |
| 4,963,029 | 10/1990 | Kipphan . | |
| 5,036,764 | 6/1991 | Rodi . | |

FOREIGN PATENT DOCUMENTS

| | | |
|---|---|---|
| 105767 | 5/1974 | German Dem. Rep. . |
| 3719766 | 7/1990 | Germany . |
| WO80/00231 | 2/1980 | WIPO . |

*Primary Examiner*—J. Reed Fisher

*Attorney, Agent, or Firm*—Herbert L. Lerner; Laurence A. Greenberg

[57] ABSTRACT

Drive for a printing press with a plurality of printing units connected to one another by a gear train, each of the printing units being associated with a motor for supplying power to the gear train, includes a control device for receiving information regarding a register deviation between two of the printing units of the printing press operating at an existing power ratio and, in accordance with the information, changing the existing power ratio of the two drive motors so as to correct the register deviation between the two drive motors.

7 Claims, 2 Drawing Sheets

DRIVE FOR A PRINTING PRESS WITH A PLURALITY OF PRINTING UNITS

SPECIFICATION

Figure 1:
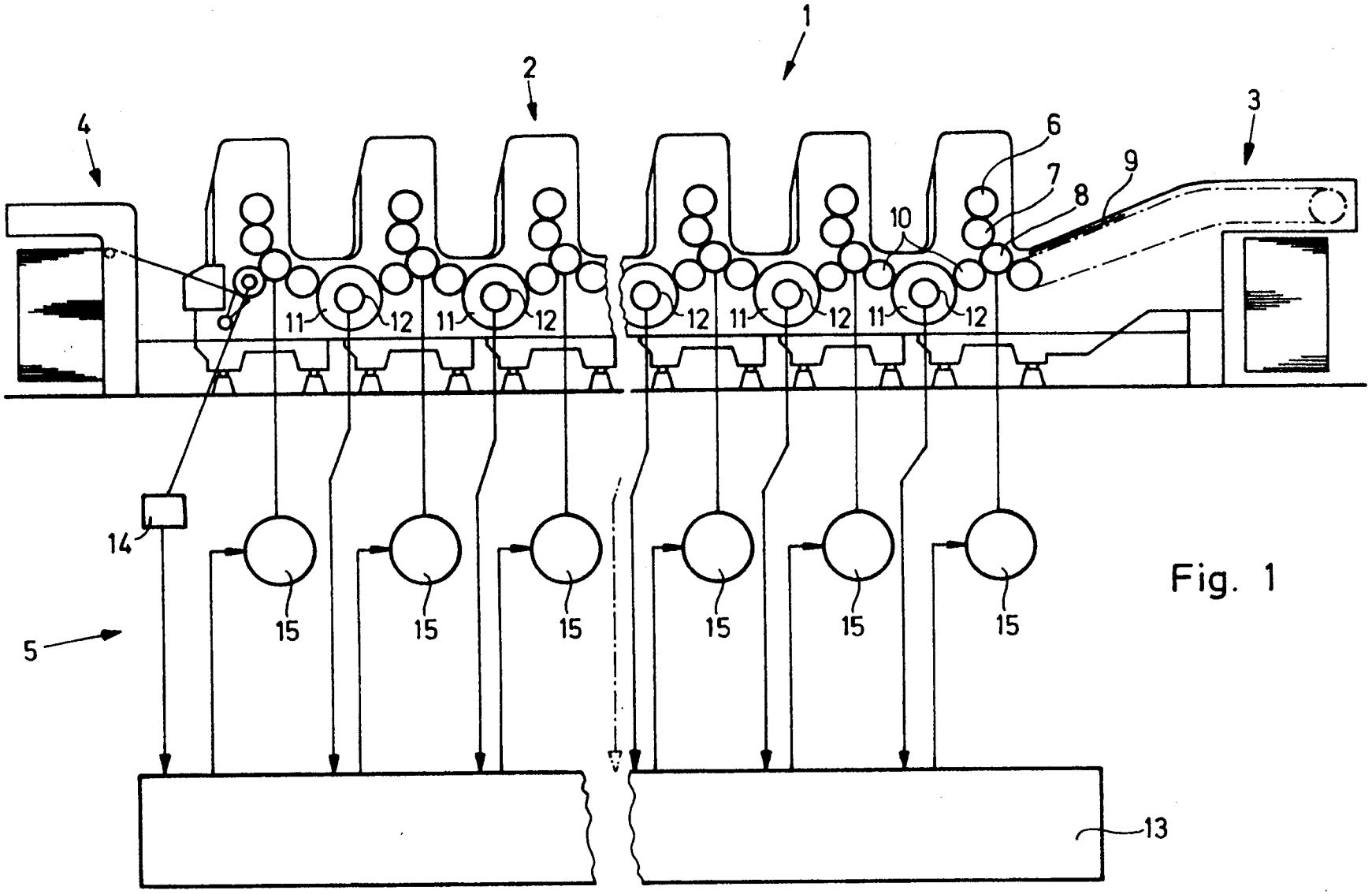

The invention relates to a drive for a printing press with a plurality of printing units, more particularly, connected to one another by a gear train, each of the printing units being associated with a motor for supplying power to the gear train.

In the field of printing technology, demands are made both in the direction of rationalization, as well as in the direction of quality improvement. In order to produce high-quality multi-color prints, which are printed on both sides and possibly also varnished, in one pass through the printing press, it is necessary, particularly in the case of sheet-fed offset printing, to dispose a plurality of printing units in tandem, i.e., behind one another. The printing in the individual printing units must take place in-register.

In order to achieve a reduction in the load applied to the gearwheels, it is conventional to employ a plurality of drives in a printing press having a plurality of printing units. In particular, each printing unit may have its own drive associated with it.

In order to achieve a defined power flow and thus a steady contact between tooth flanks or sides in the gear train, the various drives conventionally supply the gear train with different amounts of power.

Heretofore known, for example, from Patent 105 767 of the now defunct German Democratic Republic is a process and a circuit arrangement for a torque-tuning adjustment of multiple drives on printing presses with a plurality of units, wherein, as well, each unit has its own drive associated with it. In order to effect the torque-tuning adjustment of the drives, independently of the rotational speed, each unit of the printing press is connected to a direct-current shunt-wound motor, respectively having an armature connected via separately adjustable armature series resistances to a voltage source. The armature resistances of the individual drives are adjusted in accordance with the power ratio which is selected.

Conventionally, errors or deviations in the longitudinal register of the sheet between the individual printing units are corrected by conventional devices for register adjustment. Such devices ensure that the plate cylinders in the individual printing units are adjusted with respect to one another at an appropriate angle.

Due to the different amounts of power supplied in the case of multi-motor drives and/or the variable load torques dependent upon rotational speed, distortions or stresses occur in the assumed-to-be elastic gearwheels of the gear train and excite low-frequency vibrations. A consequence of these vibrations is the occurrence of register errors in the printed image in the longitudinal direction of the sheet.

It is accordingly an object of the invention to provide a multiple drive for a printing press with multiple printing units, wherein register errors occurring in the longitudinal direction of the sheet are corrected.

With the foregoing and other objects in view, there is provided, in accordance with the invention, a drive for a printing press with a plurality of printing units connected to one another by a gear train, each of the printing units being associated with a motor for supplying power to the gear train, comprising a control device having means for receiving information regarding a register deviation between two of the printing units of the printing press operating at an existing power ratio and, in accordance with the information, changing the existing power ratio of the two drive motors so as to correct the register deviation between the two drive motors.

In accordance with another feature of the invention, the information receiving means are manually operatable by a pressman detecting said information from a sheet printed in the printing press and manually introducing said information into said control device.

In accordance with an alternative feature of the invention, a register-measuring device is provided for determining the register deviation from a sheet which has been printed in the printing press, the register-measuring device being operatively connected to the control device for forwarding the information regarding the register deviation to the control device.

The register-measuring device may be used both on-line, as well as off-line. The register-measuring device may be, for example, a register-cross reader, which determines a register deviation of the individual printing colors in light of imprinted register marks. Such a register-cross reader is introduced, for example, in the published German Patent Document 37 19 766 C2. Furthermore, a determination of the register deviation may also be effected in-line, either with reference to separately imprinted register marks or in the printed image itself.

In accordance with a further feature of the invention, the drive includes a sheet detector operatively associated with a respective sheet-guiding cylinder of each of the printing units of the printing press for detecting deviations with respect to the sheet position, the sheet detector being connected to the control device for forwarding signals regarding the sheet position deviations to the control device.

In accordance with an added feature of the invention, the control device has means for determining a register deviation in the longitudinal direction of the sheet from the signals of the sheet detector. Thus, if the sheet detector registers displacements with respect to the position of the sheet, the control device corrects the respective register deviation in the longitudinal register of the sheet. This construction of the drive according to the invention permits a dynamic correction of the longitudinal register of the sheet, if necessary or desirable, from printing unit to printing unit.

In accordance with an additional feature of the invention, the printing press has a multiplicity of the printing units, each of the printing units being operatively associated with a drive motor, the power ratio of every two consecutive drive motors being changeable by the control device so as to correct the register deviation between the respective printing units. Thus, register accuracy is checked between every two consecutive printing units. By such a successive correction of the sheet position, any occurring register deviations are not additive as the sheet passes through the printing units of the printing press.

In accordance with a concomitant feature of the invention, the control device has means for supplying one of the consecutive drive motors with a power change having a positive value and for supplying the other of the consecutive drive motors with a power change having a negative value. Thus, the computed power change for correcting the longitudinal register of the sheet is fed in the form of a negative value to one of the respective two printing units, and in the form of a positive value to the other of the respective two printing units.

Other features which are considered as characteristic for the invention are set forth in the appended claims.

Although the invention is illustrated and described herein as embodied in drive for a printing press with a plurality of printing units, it is nevertheless not intended to be limited to the details shown, since various modifications and structural changes may be made therein without departing from the spirit of the invention and within the scope and range of equivalents of the claims.

Figure 2:
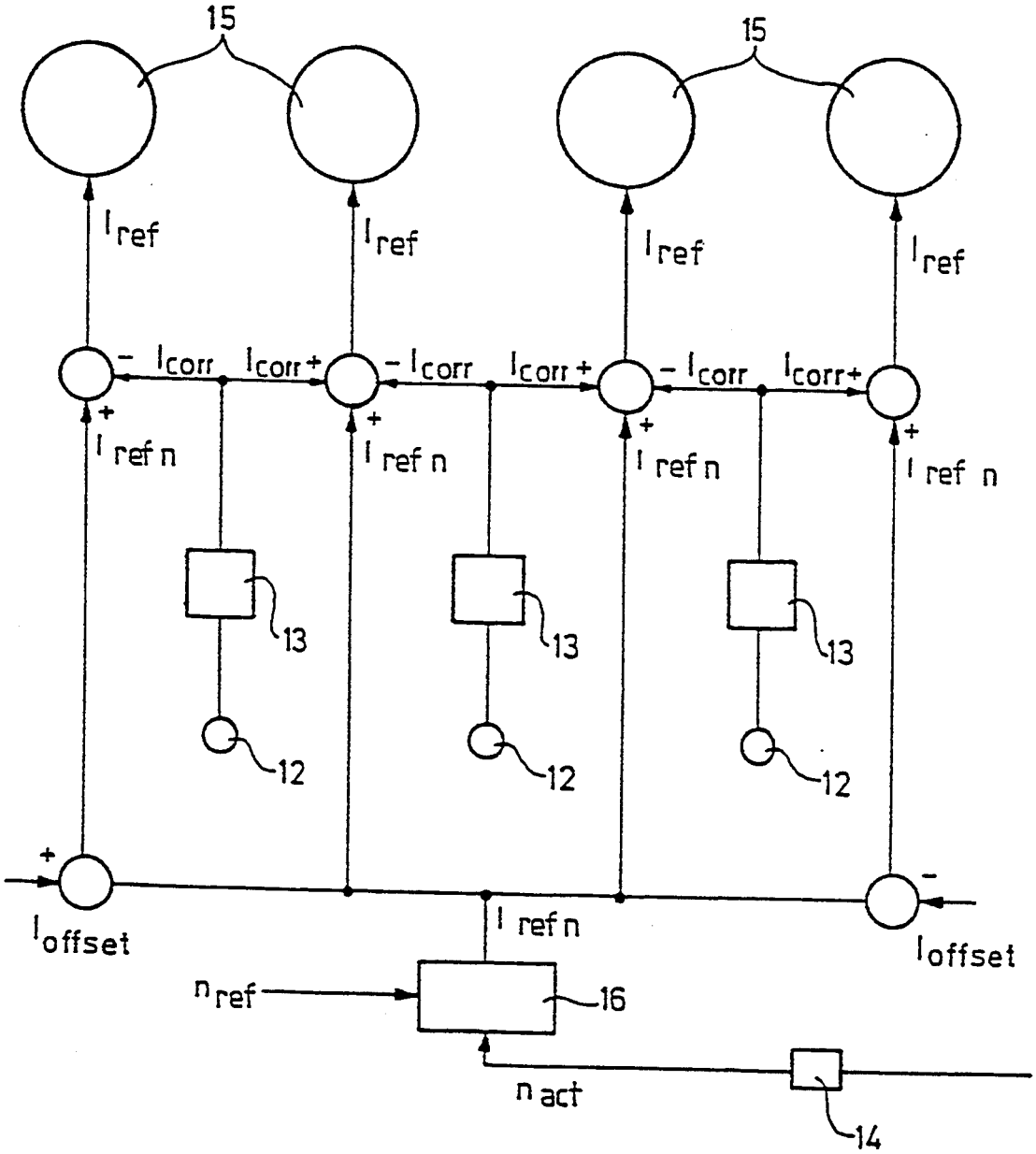

The construction and method of operation of the invention, however, together with additional objects and advantages thereof will be best understood from the following description of specific embodiments when read in connection with the accompanying drawings, in which:

FIG. 1 is a diagrammatic and schematic side elevational view of a printing press provided with a drive according to the invention; and FIG. 2 is a fragmentary schematic view, in greater detail and including a circuit diagram, of the drive according to the invention.

Referring now to the drawings and, first, particularly to FIG. 1 thereof, there is shown therein a printing press 1 with a plurality of printing units 2, a sheet feeder 3 and a delivery 4. Each of the printing units 2 has a conventional cylinder configuration, including a plate cylinder 6, a rubber-blanket cylinder 7 and an impression cylinder 8. Sheet travel through the printing press 1 is effected by means of non-illustrated conventional gripper bars operatively associated with conventional sheet transfer cylinders 10, storage drums 11 and the respective impression cylinders 8.

In order to ensure synchronized sheet transfer and, accordingly, in-register printing, the cylinders of the printing press 1 are in mutual engagement through the intermediary of a closed gear train, which is likewise not separately shown in FIG. 1. Because the gearwheels are considered to be elastic within the micrometer range relevant to printing, distortions or stressing between the gearwheels of the printing press 1 will result, nevertheless, in errors at the sheet transfer and, consequently, in register errors in the printed image.

Each of the storage drums 11,respectively, is associated with at least one sheet-position detector 12. The sheet-position detector 12 may be a photoelectric light barrier, for example. The intensity of this conventional optical sensor varies as a function of the extent to which the sheet-position detector 12 is covered or overlapped by the sheet 9.

The measured intensity values of the sheet-position detectors 12 are fed to a control device 13. Furthermore, the control device 13 receives information regarding the respective angular position of the printing press 1 from an angle sensor 14.

Should deviations with respect to synchronized sheet transfer occur between two printing units 2 due to distortions between the gearwheels of the cylinders, the control device 13 determines correction values for controlling drive motors 15. Each printing unit 2 has a separate drive motor 15 associated therewith, which supplies power to the gear train. In particular, the drive motors 15 are operatively associated with the impression cylinders 8 of the printing press 1.

FIG. 2, as aforementioned, is a fragmentary circuit diagram of the drive according to the invention. The individual printing units are controlled through the intermediary of the drive motors 15. Information regarding angle and rotational speed is fed to a rotational-speed controller 16 from an angle sensor 14, which is disposed on a shaft of a cylinder of the printing press 1. In a conventional manner, a current control is subordinate to or supports the rotational-speed control. The rotational-speed controller 16 corrects actual current value I whenever a deviation occurs between the measured rotational speed $n_{act}$ and a prescribed rotational-speed setpoint value $n_{ref}$.

A like current setpoint value $I_{ref\,n}$ is prescribed for all of the drive motors 15. In order to optimize contact between tooth flanks or sides in the gear train, in accordance with an advantageous further development of the invention, an offset current $I_{offset}$ can be impressed on the rotational-speed control loop.

If the measured values from the sheet-position detectors 15 yield a deviation with regard to synchronized sheet transfer between two printing units 2, the control device 13 calculates a correction value $I_{corr}$ of the current setpoint value $I_{ref\,n}$ based upon the difference in position of the sheet 9. This correction value $I_{corr}$ is applied in the form of a positive correction value $I_{corr}$ to one of the two printing units 2 between which the difference has occurred during the sheet transfer, and in the form of a negative correction value $I_{corr}$ to the other printing unit 2. Assurance is thereby provided that the sum of the currents $I_{ref\,n}+I_{corr}$ and $I_{ref\,n}-I_{corr}$ and, accordingly, the driving torque of the two drive motors 15 remains constant.

The drive according to the invention thus permits the possibility of compensating for a difference in position of or a positional error in the sheet 9 between two printing units 2 by the time the sheet 9 arrives, at the next impression cylinder 8.

A decision as to whether a correction is to be performed between two consecutive printing units 2 or between two printing units 2 which are spaced-apart farther depends upon the magnitude of the displacement of the sheet 9 at the time of sheet transfer. If the register error is within the provided tolerance range, then it is also perfectly possible to effect a correction between two printing units 2 which are not directly behind one another. Because register errors between two printing units 2, however, are generally additive successively as the sheet 9 passes through the printing press 1, it is advantageous for register errors occurring between two consecutive printing units 2 to be compensated for by means of the drive 5 according to the invention.

The foregoing is a description corresponding in substance to German Application P 42 18 604.8, dated Jun. 5, 1992, the International priority of which is being claimed for the instant application, and which is hereby made part of this application.

We claim:

1. In a printing press having a plurality of printing units arranged in a sequence of pairs of adjacent units, each unit having a printing cylinder, and being connected to one another by a gear train, an equal plurality of drive motors respectively connected with one of the printing units and arranged in pairs of adjacent drive motors corresponding to each pair of adjacent printing units for supplying drive power to the gear train, the improvement comprising in combination a control device for each pair of adjacent motors having input means for receiving sheet deviation information for each printing unit driven by a respective one of said pairs of adjacent motors, said deviation information relating to register deviation between each pair of the printing units of the printing press driven by a respective one of a respective pair of adjacent motors, operating at a given power ratio in accordance with said deviation information, further control means connected between said control device and each of said pair of adjacent motors operative for changing the existing power ratio of said pair of drive motors so as to correct said register deviation between said pair of drive motors.

2. The improvement according to claim 1, wherein said further control means include manual inputs for entering manually detected deviation information from a sheet printed in the printing press into said further control means.

3. The improvement according to claim 1, including a sheet position detector connected to said control device for determining said deviation information from a sheet which has been printed in the printing press, said sheet position detector in operative engagement with said control device for forwarding said deviation information to said control device.

4. The improvement according to claim 1, wherein said sheet position detector is in operative engagement with a respective cylinder of each of the printing units for detecting register deviations, said sheet position detector being connected to said control device for forwarding said deviation information to said control device.

5. The improvement according to claim 4, wherein said sheet position detectors have means for determining register deviation information in the longitudinal direction of the sheet from said signals of said sheet detector.

6. The improvement according to claim 1, wherein each of the drive motors has a current setpoint value prescribed for each motor, a current correcting device for each motor having at least two current correcting inputs wherein a first one of said current correcting inputs is operative for receiving said current setpoint value, and a second one of said current correcting inputs is connected to an output of said control device for correcting the power ratio between each of said pair of drive motors so as to correct the register deviation between the respective printing units.

7. The improvement according to claim 6, wherein said current correcting device includes a motor current reference output connected to the respective motor, and wherein said first current correcting input is operative for supplying a respective one of said drive motors with a power change input having a positive value and said second current correcting input is operative for supplying an adjacent one of said pair of drive motors with a power change having a negative value.

* * * * *